US010584569B2

(12) United States Patent
Gamage et al.

(10) Patent No.: US 10,584,569 B2
(45) Date of Patent: Mar. 10, 2020

(54) ELECTRIC HEAT AND NGL STARTUP FOR HEAVY OIL

(71) Applicant: CONOCOPHILLIPS COMPANY, Houston, TX (US)

(72) Inventors: Siluni L. Gamage, Houston, TX (US); T. J. Wheeler, Houston, TX (US); Robert S. Redman, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/955,125

(22) Filed: Apr. 17, 2018

(65) Prior Publication Data

US 2018/0328155 A1 Nov. 15, 2018

Related U.S. Application Data

(60) Provisional application No. 62/506,297, filed on May 15, 2017.

(51) Int. Cl.
*E21B 43/24* (2006.01)

(52) U.S. Cl.
CPC ..... *E21B 43/2408* (2013.01); *E21B 43/2401* (2013.01)

(58) Field of Classification Search
None
See application file for complete search history.

(56) References Cited

U.S. PATENT DOCUMENTS

| | | | | |
|---|---|---|---|---|
| 4,456,065 | A | 6/1984 | Heim et al. | |
| 5,120,935 | A | 6/1992 | Nenniger | |
| 6,353,706 | B1 | 3/2002 | Bridges | |
| 7,069,993 | B2 | 7/2006 | Hill | |
| 8,265,468 | B2 | 9/2012 | Carr, Sr. | |
| 2010/0258309 | A1* | 10/2010 | Ayodele | E21B 43/243 166/272.3 |
| 2011/0186292 | A1* | 8/2011 | Wheeler | E21B 43/24 166/272.3 |
| 2011/0303423 | A1 | 12/2011 | Kaminsky et al. | |
| 2012/0138293 | A1 | 6/2012 | Kaminsky et al. | |
| 2014/0202686 | A1 | 7/2014 | Trautman et al. | |
| 2014/0345861 | A1 | 11/2014 | Stalder et al. | |
| 2015/0041128 | A1* | 2/2015 | Hytken | E21B 43/126 166/272.3 |
| 2017/0298718 | A1* | 10/2017 | Mills | E21B 23/10 |

FOREIGN PATENT DOCUMENTS

CA 2235085 A1 10/1999

* cited by examiner

*Primary Examiner* — Anuradha Ahuja
(74) *Attorney, Agent, or Firm* — Boulware & Valoir

(57) ABSTRACT

A method starts wells with electrical downhole heating and injects solvent(s) or NGL mixes as a preconditioning for a steam injection process. The downhole electrical heating and solvent injection recovers oil and reduces the reservoir pressure. Once oil has been recovered for a period of time and the operating pressure and temperature has been reduced, steam or steam and solvent(s) may be injected to produce high oil recoveries at faster production rates than downhole heating or downhole heating and solvent(s) injection alone. The method reduces heat losses due to steam injection at lower pressure and temperature and therefore, improves efficiency and lowers operating costs. Operating at lower pressure and temperature also reduces the risk of melting the permafrost and consequent well failure issues.

18 Claims, 11 Drawing Sheets

Total Cumulative Heat = 1.5E+10 Btu

Total Cumulative Heat = 5.3E+11 Btu

Total Cumulative Heat = 3.3E+10 Btu

Total Cumulative Heat = 1.5E+10 Btu

ELECTRIC HEAT AND NGL STARTUP FOR HEAVY OIL

PRIOR RELATED APPLICATIONS

This application is a non-provisional application which claims benefit under 35 USC § 119(e) to U.S. Provisional Application Ser. No. 62/506,297 filed May 15, 2017, entitled "ELECTRIC HEAT & NGL STARTUP FOR HEAVY OIL" which is incorporated herein in its entirety.

FIELD OF THE INVENTION

This invention relates generally to methods of preconditioning wells without using steam. This new preconditioning method uses electric inline heaters and natural gas liquids (NGL) to reduce the viscosity of heavy oil.

BACKGROUND OF THE INVENTION

Oil sands are a type of unconventional petroleum deposit. The sands contain naturally occurring mixtures of sand, clay, water, and a dense and extremely viscous form of petroleum technically referred to as "bitumen," but which may also be called heavy oil or tar. Many countries in the world have large deposits of oil sands, including the United States, Russia, and the Middle East, but the world's largest deposits occur in Canada and Venezuela.

Bitumen is a thick, sticky form of crude oil, so heavy and viscous (thick) that it will not flow unless heated or diluted with lighter hydrocarbons. At room temperature, bitumen is much like cold molasses. Often times, the viscosity can be in excess of 1,000,000 cP.

Due to their high viscosity, these heavy oils are hard to mobilize, and they generally must be made to flow in order to produce and transport them. One common way to heat bitumen is by injecting steam into the reservoir. Steam Assisted Gravity Drainage (SAGD) is the most extensively used technique for in situ recovery of bitumen resources in the McMurray Formation in the Alberta Oil Sands (Butler, 1991).

In a typical SAGD process, shown in FIG. 1, two horizontal wells are vertically spaced by 4 to 10 meters (m). The production well is located near the bottom of the pay and the steam injection well is located directly above and parallel to the production well. In SAGD, a "startup" or "preheat" period is required before production can begin. The typical startup lasts 3-6 months, and during that time, steam is injected continuously into both wells until the wells are in fluid communication. At that time, the lower well is converted over to a producer, and steam is injected only into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity within steam chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Conventional SAGD tends to develop a cylindrical steam chamber with a somewhat tear drop or inverted triangular cross section. With several SAGD well pairs operating side by side, the steam chambers tend to coalesce near the top of the pay, leaving the lower "wedge" shaped regions midway between the steam chambers to be drained more slowly, if at all. Operators may install additional producing wells in these midway regions to accelerate recovery, as shown in FIG. 2, and such wells are called "infill" wells, filling in the area where oil would normally be stranded between SAGD well-pairs.

Although quite successful, SAGD does require enormous amounts of water in order to generate a barrel of oil. Some estimates provide that 1 barrel of oil from the Athabasca oil sands requires on average 2 to 3 barrels of water, although with recycling the total amount can be reduced to 0.5 barrel. In addition to using a precious resource, additional costs are added to convert those barrels of water to high quality steam for downhole injection. Therefore, any technology that can reduce water or steam consumption has the potential to have significant positive environmental and cost impacts.

Another problem with steam-based methods is that they may not be appropriate for use in the Artic, where injecting large amounts of steam for months and years on end has high potential to melt the permafrost, allowing pad equipment and wells to sink, with potentially catastrophic consequences. Indeed, the media is already reporting the slow sinking of Artic cities, and cracking and collapsing homes are a growing problem in cities such as Norilsk in northern Russia.

Therefore, although beneficial, the SAGD concept could be further developed to address some of these disadvantages or uncertainties. In particular, a method that reduces steam use would be beneficial, especially for Artic tundra environments, where steam based methods may be hazardous or impractical.

SUMMARY OF THE DISCLOSURE

Current SAGD practice involves arranging horizontal production wells low in the reservoir pay interval and horizontal steam injection wells approximately 3-10 meters above (usually about 5) and parallel to the producing wells. Well pairs may be spaced between 50 and 150 meters laterally from one another in parallel sets to extend drainage across reservoir areas developed from a single surface drilling pad.

Typically, both production and injection wells are preheated by circulating steam from the surface down a toe tubing string that ends near the toe of the horizontal liner; steam condensate returns through the tubing-liner annulus to a heel tubing string that ends near the liner hanger and flows back to the surface through this heel tubing string. After such a period of "startup" circulation in both the producer and the injector wells for a period of about 3-6 months, the two wells will reach fluid communication. The reservoir midway between the injector and producer wells will reach a temperature high enough (50-100° C.) so that the bitumen becomes mobile and can drain by gravity downward, while live steam vapor ascends by the same gravity forces to establish a steam chamber. At this time, the wellpair is placed into SAGD operation with injection in the upper well and production from the lower well, and production can begin.

Previous studies have shown that SAGD process could produce high oil recoveries in the Ugnu reservoir, which is a heavy oil reservoir in Alaska. However, Ugnu reservoir is at about a 3000 ft depth where steam injection would need to be conducted at very high pressure and temperatures, exceeding 300° C. Operating at high depths could cause higher heat losses, even when vacuum insulated tubing (VIT) is used and could also cause issues with delivering high quality steam to the heel of the horizontal well. These inefficiencies will result in higher operating costs and lower oil recoveries. Furthermore, prolonged use of high temperature steam risks melting the permafrost, resulting in well subsidence and well failure issues.

Instead of steam use for startup, we propose the use of downhole electric heating along with solvents, especially NGL mixes available in the North Slope of Alaska, to reduce the oil viscosity and lower the operating pressure and operating temperature for the wells. Using downhole heating and producing oil reduces the pressure in the area surrounding the well, and once heating is discontinued or slowed temperature will also reduce. Therefore, the solvents/NGL could be injected at a lower pressure, especially if the solvents are injected after operating the well(s) with downhole heating for a period of time. Downhole heating and the use of available NGL mixes is a low cost method to recovering oil in comparison to steam injection.

This preconditioning or "startup" method is then combined with another steam-based or steam-and-gas-based method for oil production, such as SAGD, expanding solvent SAGD (ES-SAGD) aka solvent assisted SAGD (SA-SAGD), low pressure SAGD (LP-SAGD); high pressure SAGD (HP-SAGD), steam drive aka steam flooding, cyclic steam stimulation (CSS) aka "huff-and-puff", Steam and Gas Push (SAGP), and the like.

CA2235085 to Nenniger describes a similar methodology wherein a downhole heater is used to heat a heat transfer fluid such as methane, ethane, butane, propane, pentane and hexane. Once a solvent chamber is formed, the method is combined with cold solvent extraction. Subsequent cold solvent injection will theoretically achieve commercial production rates without requiring additional heat.

However, our method differs in that it is combined with steam-based production methods once reservoir pressure and temperature are sufficiently reduced, and thus will reduce heat losses due to steam injection at lower pressure and temperature and therefore, will improve efficiency and lower operating costs of the process. Operating at lower pressure and temperature will also reduce the risk of melting the permafrost and reduce well subsidence and well failure issues.

US20110303423 is entitled "Viscous oil recovery using electric heating and solvent injection." This application uses solvent in the reservoir to mitigate water vaporization during electrical heating near wellbore. By contrast, we use electrical heating to reduce the operating pressure of the well. The amount of electrical heating supplied herein (50-150 W/ft) would not allow the water in the reservoir to vaporize since the near wellbore temperature is much cooler than the steam temperature at our operating pressures. The low temperatures of downhole heating from the simulation results are visible in FIG. 12. We would use solvent/NGL injection followed by electrical downhole heating to further produce oil and the use of electrical heating is not to vaporize the solvent as stated in this patent application. Simulations will also show that the heat injected into the reservoir in downhole heating is much lower than the heat injected by steam injection at our operating pressures. Therefore, downhole heating will result in low heat transfer to the permafrost and cause less well subsidence issues.

In more detail, the proposed method is to use downhole heating combined with solvent/NGL injection (either simultaneously or sequentially or a combination thereof) to reduce the oil viscosity and recover oil. Since low cost NGL mixes are readily available in the North Slope of Alaska, an NGL mix could be injected in a well with a downhole electrical heater installed. This methodology could reduce oil viscosity (both heating and solvents reduce the oil viscosity) and recover oil from the Ugnu reservoir. Once oil is being produced, the pressure will drop and the heating can then be discontinued, allowing the T to also drop somewhat from the heated high.

However, this method will not recover oil at high production rates in comparison to a steam injection process, because steam is much more efficient in delivering heat to the reservoir, especially far away from the wells as the steam chamber grows. Steam can provide both convective and conductive heat to the reservoir, whereas electrical heating could only provide conductive heating, which is a slow process.

Therefore, to improve production rates, small amounts of hot water/steam and/or gas could also be co-injected with the NGL mix/solvent(s) once the wells reach fluid communication and P has been reduced and T reduced from its high point, e.g., after the preconditioning period. The gas could provide a "drive mechanism" by enabling counter-current displacement of oil vertically above the well. Alternatively, the wells can be switched to traditional steam-based methods or steam and gas or steam and solvent based methods, as desired.

In one embodiment, we use just one well equipped with a downhole heater (e-heating) and then follow up with solvent(s)/NGL injection. In another embodiment, the e-heating and injection overlap somewhat. In yet another variation, they completely overlap. After this initial preheating period, the heater is stopped, and oil is collected, thus reducing T and P, and allowing the follow up of steam based methods, but at lower T than would otherwise be possible. In other methods, the heater can be left on or turned back on for a portion or all of the steam based methods.

In another embodiment, however, we use wellpairs similar to SAGD orientation and use downhole heaters or downhole heaters and solvent(s)/NGL in both wells for the preconditioning period to establish communication between the wells. Once communication is established, the preheat is discontinued and oil produced, which will have the effect of lowering both T and P. Then any other steam-based methods can be applied, such as SAGD or ES-SAGD (steam and solvent), but a lower T than would otherwise be required. Thus, we reduce the impact on the permafrost.

Another advantage of this methodology is that downhole heating combined with solvent injection will lower the operating pressure and temperature of the wells and recover oil at the same time. Since electrical heating and solvent(s) injection is conducted first, and some oil is recovered, the reservoir pressure will decline. Steam could then be injected at a lower pressure and temperature to recover more oil at faster production rates. The needed steam injection temperature will be lower because the pressure surrounding the well has been reduced by downhole heating and producing near wellbore oil. Therefore, this pre-conditioning methodology improves the efficiency of the steam injection process by reducing the heat losses due to injecting steam at a lower pressure and temperature.

High temperature steam allows more heat losses to the overburden/underburden and the produced fluids will also be at a higher temperature. However, since the reservoir is at a much higher depth and therefore, the bottomhole pressure is high, plus we have to inject steam through permafrost. Higher bottomhole pressure requires higher steam injection temperature (for it to stay as steam), but if we inject steam at high temperatures we may lose more heat to the permafrost while it is being transferred to the horizontal section of the well. The preconditioning with electric heat and NGL mitigates these problems, reducing the risk to the permafrost. Although electric heating is less efficient than steam, the majority of Ugnu (Alaska) heavy oil resources are at much lower viscosities than in Athabasca bitumen and therefore, we do not need to reduce the viscosity as much to get it to flow.

Furthermore, this methodology could also be used as a preconditioning method for other thermal recovery processes, such as Expanding Solvent SAGD (ES-SAGD, aka Solvent Assisted Process or SAP-SAGD), enhanced SAGD (eSAGD) methods where steam and solvent(s) are injected into the reservoir together. The solvent(s) used in this method could also be the NGL mixes available in the North Slope of Alaska.

Wells can be traditional horizontal SAGD wellpair(s) (FIG. 3), the injectors being vertically stacked over the producers, and infill wells can also be used (FIG. 4). In the alternative, laterally separated wells can be used instead of being directly vertically stacked if the wells include multilateral wells to cover the play between (FIG. 5A-B). We could also use a single horizontal well if downhole heating and solvent(s) injection is used alone.

In addition, the wells can be vertical for horizontal drive-based methods. For example, vertical injectors and producers can be arranged by either bracketing a producer with injectors (FIG. 6) or the reverse (FIG. 7). Arrays of producers and injectors can also be used to cover the play.

The electrical downhole heater can be any known in the art or to be developed. For example, the patent literature provides some examples: U.S. Pat. Nos. 7,069,993, 6,353,706 and 8,265,468. There are also commercially available downhole electric heaters. ANDMIR™, for example One particularly useful example is the PETROTRACE™ by PENTAIR™. The typical system including a downhole electric heating cable, ESP electrical cable, power connection and end termination kits, clamping systems, temperature sensors, wellhead connectors and topside control and monitoring equipment. The cable has an operating temperature up to 122° F. (50° C.), provides up to 41 W/m, and is housed in a flexible armored polymer jacket, allowing for ease of installation on the outside of the production tube. Further, the cables are available in different sizes and power levels and in lengths of up to 3,937 ft (1,200 m). Advantageously, the heater can be configured so that more power and heat is delivered to the toe of a well. Heaters can also be deployed inside the outer casing, outside production tubing, in coiled tubing, outside of the casing, but preferably the heating cable lies outside the production tubing and/or in contact with slotted liner.

Further, since the heating zone of a electric heater can be controlled by changing the conductivity/resistance and insulation of the wire, the method avoids high heat levels at the surface that are provided by steam-based methods. This method can thus be used in areas where SAGD and other steam injection processes are less viable due to high risk and cost associated with operating at high temperature and pressure conditions. In particular, Artic tundra wells may be less suitable for steam injection methods because the injection of steam from the surface tends to melt the permafrost, which can then allow pad equipment and tubing to become destabilized and even sink.

The invention can comprise any one or more of the following embodiments, in any combination:

A method for production of heavy oil, the method comprising: providing an injector well in a heavy oil reservoir at a first pressure, said injector well configured for electric downhole heating with an electric heater and for injection of one or more solvents; providing a producer well configured for production of heavy oil; preconditioning by heating said injector well with said electric heater and injecting a solvent or natural gas liquid (NGL) into said injection well for a period until said wells are in fluid communication and producing heavy oil at said producer well until said first pressure is reduced; injecting steam into said injection well at a lower temperature than would otherwise be required without said preconditioning step; and continuing production of heavy oil at said producer well.

A method for production of heavy oil, the method comprising: providing a well in a heavy oil reservoir at a first pressure, said well configured for electric downhole heating using an electric heater cable and for injection of one or more solvents; heating said well with said electric heater cable; producing heavy oil at said well and/or at an adjacent well until said first pressure is reduced to a second pressure; injecting solvent(s) or an NGL into said well until said second pressure is reduced; injecting steam into said well at a lower temperature than would otherwise be required without the precondition by e-heating and solvent/NGL injection; and continuing production of heavy oil at said well and/or said adjacent well.

A method for production of heavy oil in a region of permafrost, the method comprising: providing a well in a heavy oil reservoir in a region of permafrost, said heavy oil reservoir at a first temperature and a first pressure, said well configured for electric downhole heating using an electric heater cable and for injection of a natural gas liquid (NGL) produced at or near said well; heating said well with said electric heater cable to heat said well to a second temperature to reduce a viscosity of heavy oil; injecting said NGL into said well to reduce a viscosity of heavy oil; producing heavy oil at said well or an adjacent well until said first pressure is reduced; discontinuing said heating step; producing heavy oil at said well or an adjacent well until said second temperature is reduced; injecting steam into said well at a lower temperature than would otherwise be required without the e-heating and solvent/NGL injection, thereby reducing a risk of melting said permafrost; and continuing production of heavy oil at said well or said adjacent well.

Any method herein described, wherein said producer well is also configured for electric downhole heating with an electric heater and is also heated during said preconditioning step.

Any method herein described, wherein said electric heater is an electric heater cable deployed inside said injector well.

Any method herein described, wherein said heating step with said electric heater is discontinued before said injecting steam step.

Any method herein described, wherein said injecting steam step is co-injection of steam and a gas or solvent or NGL.

Any method herein described, wherein said producer well and said injector well are vertically stacked horizontal wells. They could also be vertically stacked horizontal wells about 4-10 m apart, preferably about 5 meters apart. They could instead both be vertical wells.

Any method herein described, wherein said one or more solvents is methane, ethane, propane, butane, pentane, hexane or mixtures thereof. An NGL could also be used. Most preferred in an NGL condensate produced at or near said wells.

Any method herein described, wherein less heat is needed to produce oil than would be required with steam alone. Preferably, 10× less heat is needed, 20×, 30× or even 35 fold less heat.

"Vertical" drilling is the traditional type of drilling in oil and gas drilling industry, and includes well <45° of vertical.

"Horizontal" drilling is the same as vertical drilling until the "kickoff point" which is located just above the target oil or gas reservoir (pay zone), from that point deviating the drilling direction from the vertical to horizontal. By "horizontal" what is included is an angle within 45° (≤45°) of horizontal. All horizontal wells will have a vertical portion, but the majority of the well is within 45° of horizontal.

A "lateral" well as used herein refers to a well that branches off an originating well. An originating well may have several such lateral wells (together referred to as multilateral wells), and the lateral wells themselves may also have lateral wells.

"Multilateral" wells are wells having multiple branches or laterals tied back to a mother wellbore (also called the "originating" well), which conveys fluids to or from the surface. The branch or lateral is typically horizontal, but can curve up or down.

As used herein, "NGL" or natural gas liquids are components of natural gas that are separated from the gas state in the form of liquids. This separation occurs in a field facility or in a gas processing plant through absorption, condensation or other method. Natural gas liquids are classified based on their vapor pressure: Low=condensate, Intermediate=natural gas, High=liquefied petroleum gas. Examples of NGLs used herein include ethane, propane, butane, isobutane and pentane.

As used herein, it is understood that injecting "steam" may include some injection of hot water as the steam loses heat and condenses or a wet steam was used.

As used herein, the "preconditioning period" is that time wherein solvent is injected or the well heated, or both, until the initial P of the well is reduced, and the high temperature may also be reduced, and the well converted to steam-based methods.

As used herein, operating pressure is the pressure at which oil is produced during the steam based methods. "Operating temperature" also refers to the temperature at which oil is produced during the steam based methods. The P&T are typically higher during the preconditioning period.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| SAGD | Steam assisted gravity Drainage |

DETAILED DESCRIPTION OF THE DISCLOSURE

Figure 1:
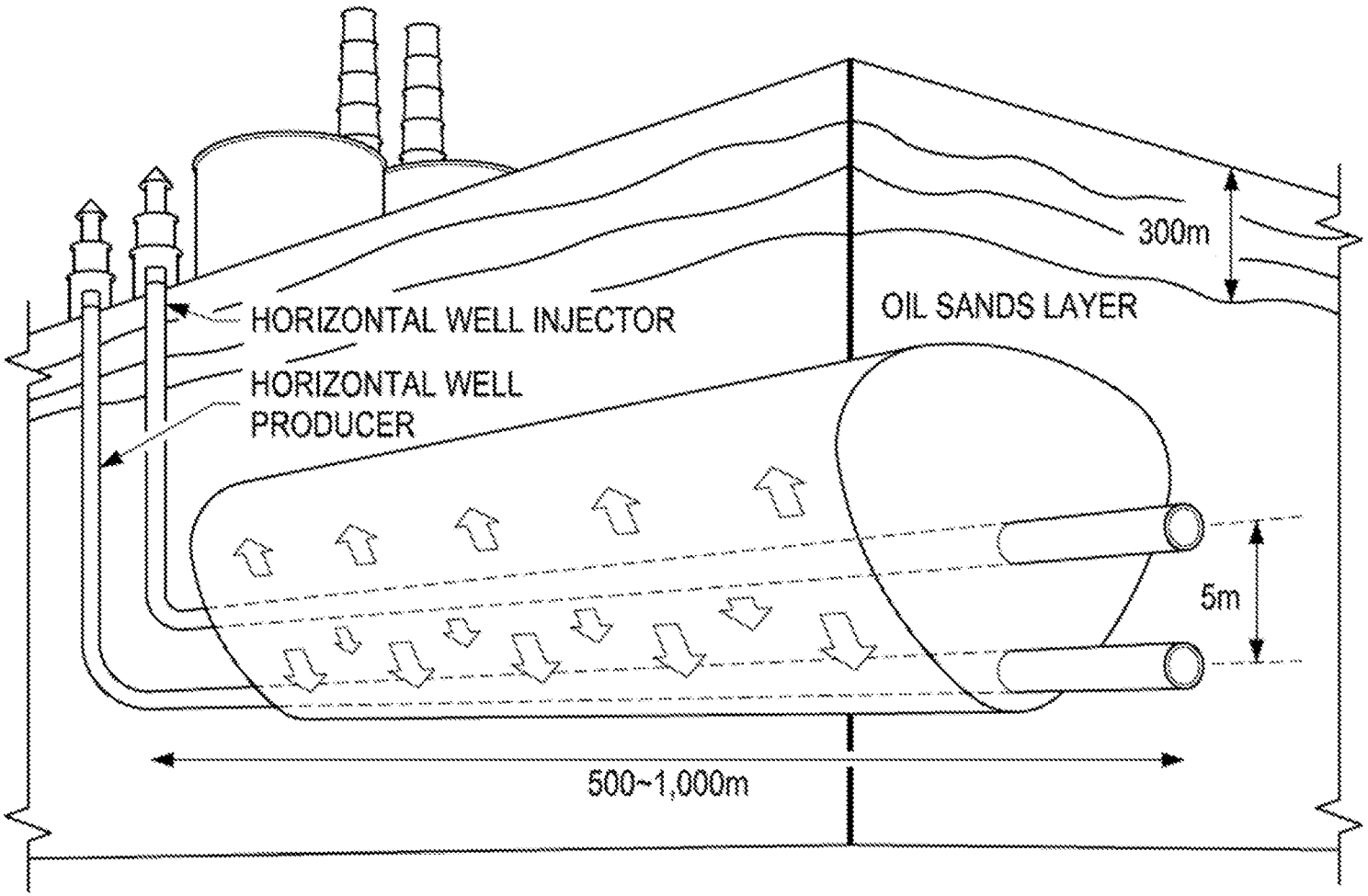
FIG. 1 (PRIOR ART)
FIG. 1 shows a conventional SAGD well pair.
Figure 2:
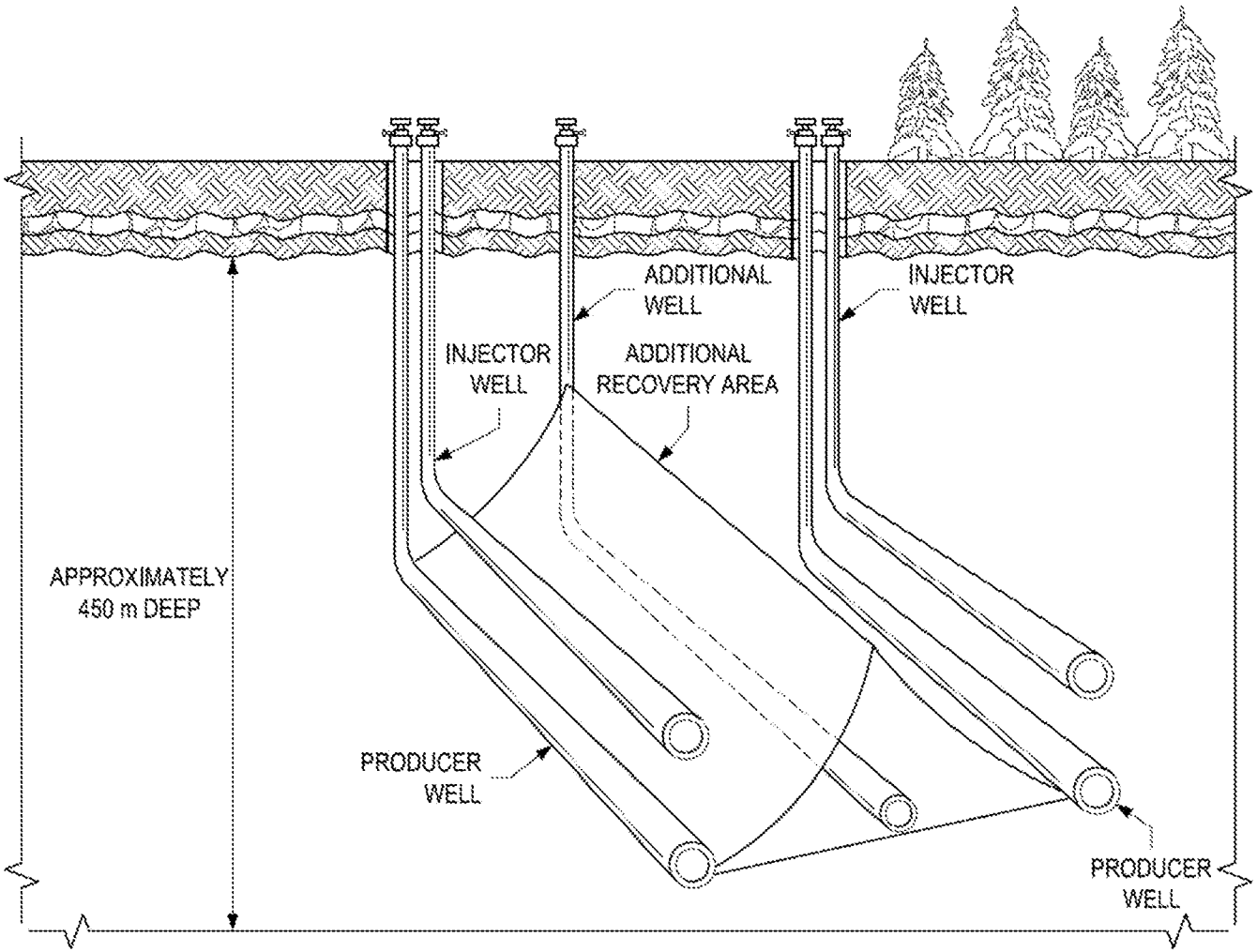
FIG. 2 (PRIOR ART)
FIG. 2 shows the addition of an additional production well between a pair of SAGD well pairs to try to capture the "wedge" of oil between pairs of well pairs that is typically left unrecovered. This midpoint lower well in known as an "infill" well.
Figure 3:
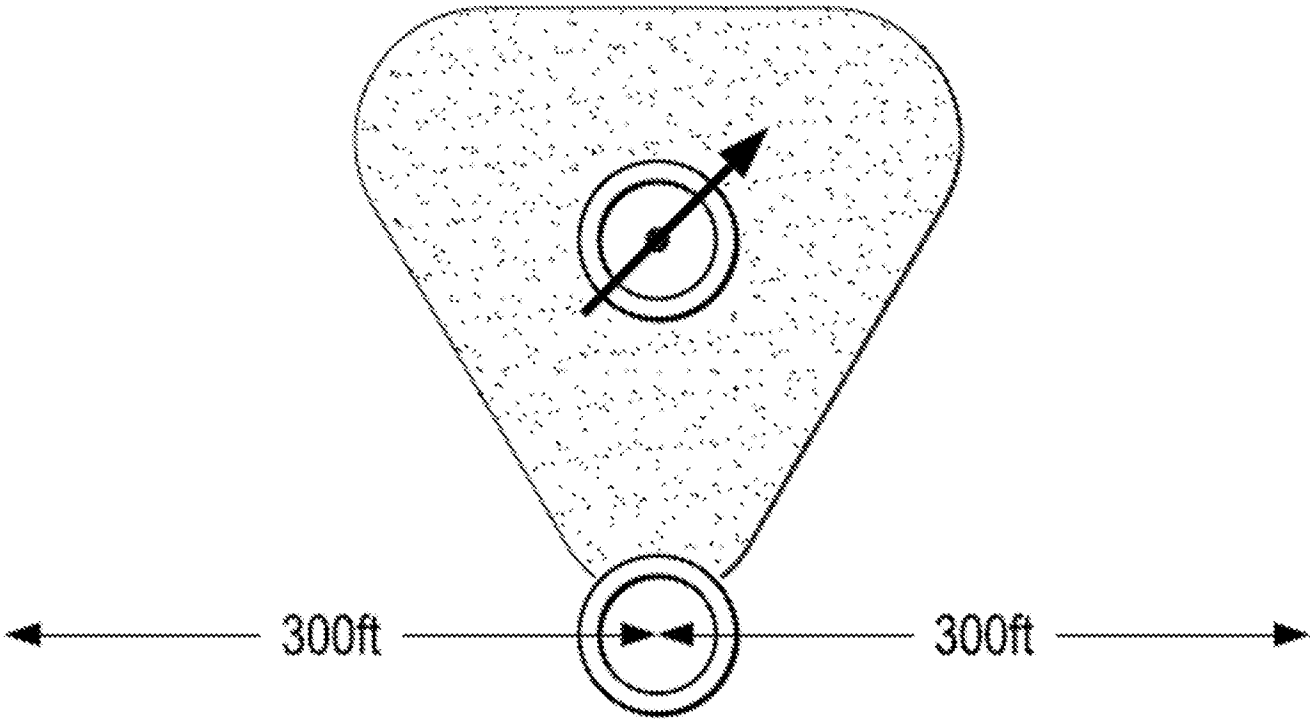
FIG. 3 shows a side view of a traditional horizontal well pair, with injectors about 4-10 m above a producer, and about 300 meter to the next well pair.
Figure 4:
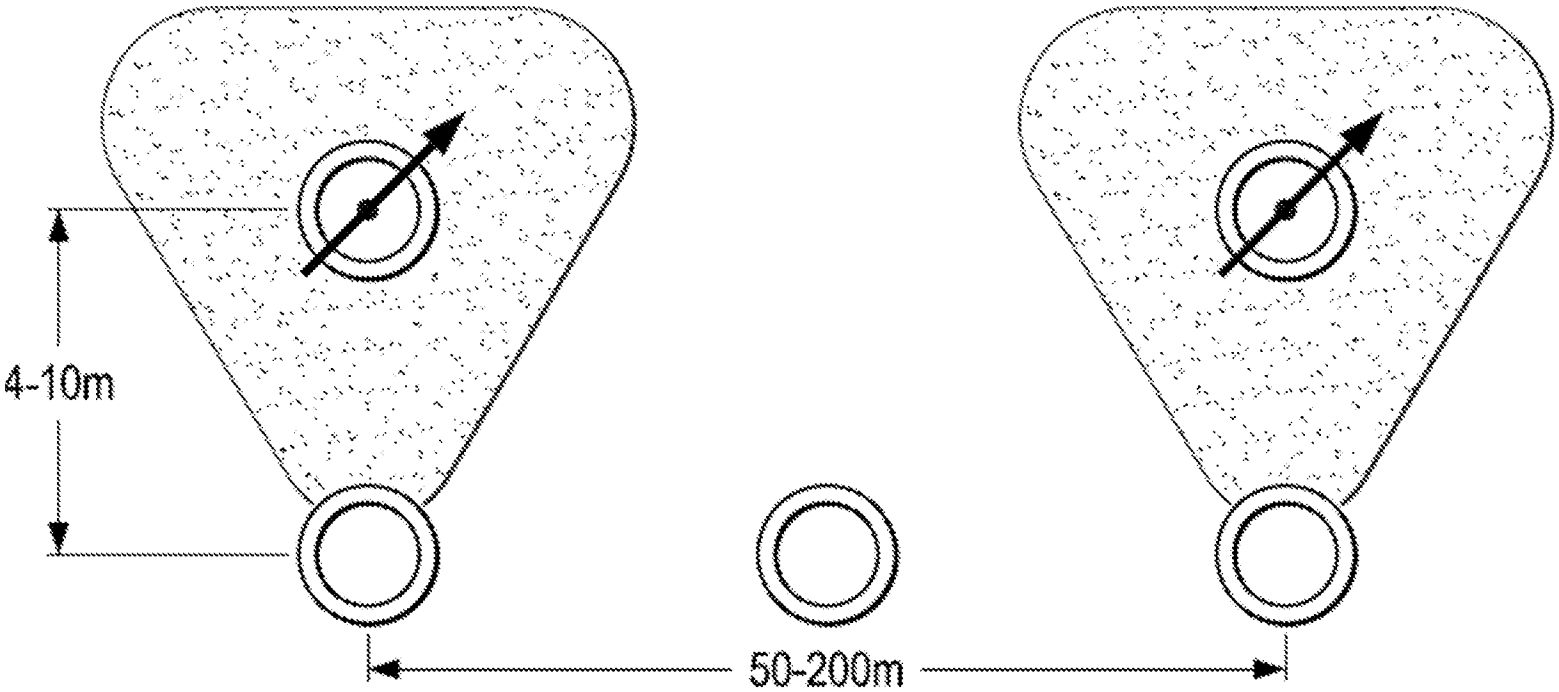
FIG. 4 shows a side view of a pair of traditional horizontal well pairs, with in infill well therebetween.
Figure 5A:
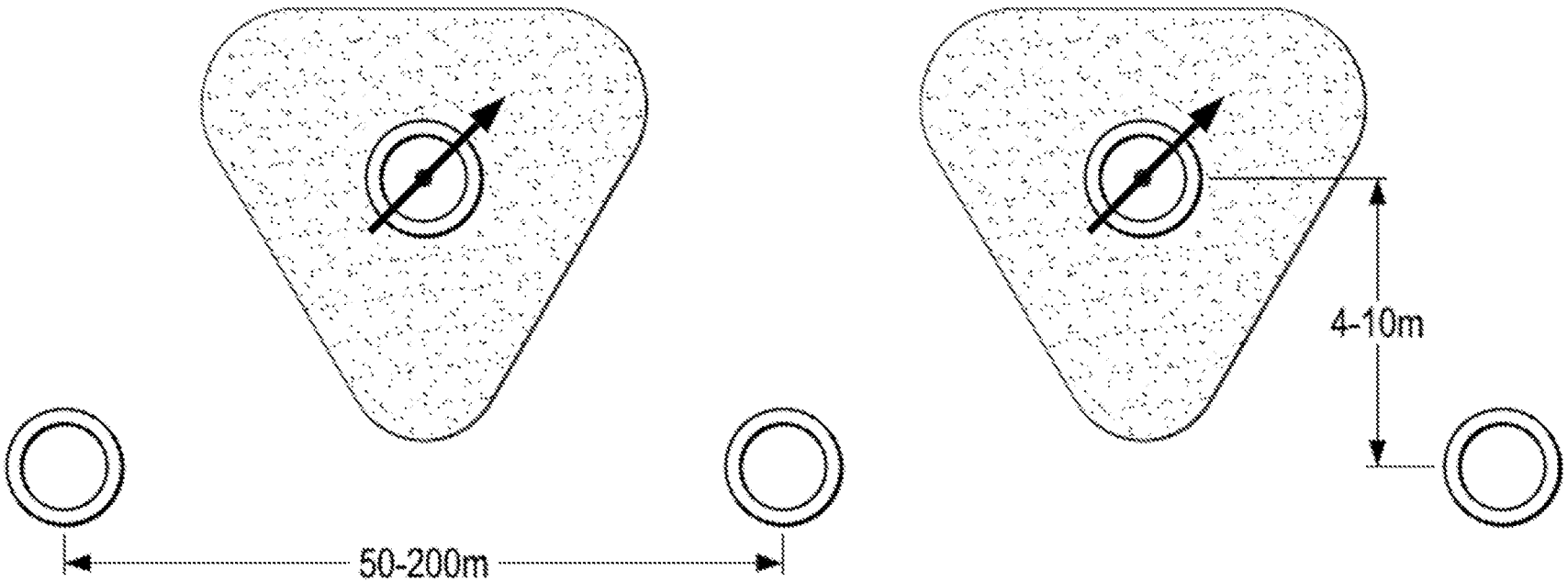
FIG. 5A and FIG. 5B shows laterally separate well pairs from the side (A) and top (B) wherein lateral wells cover the lateral distance from a producer to an injector.
Figure 5B:
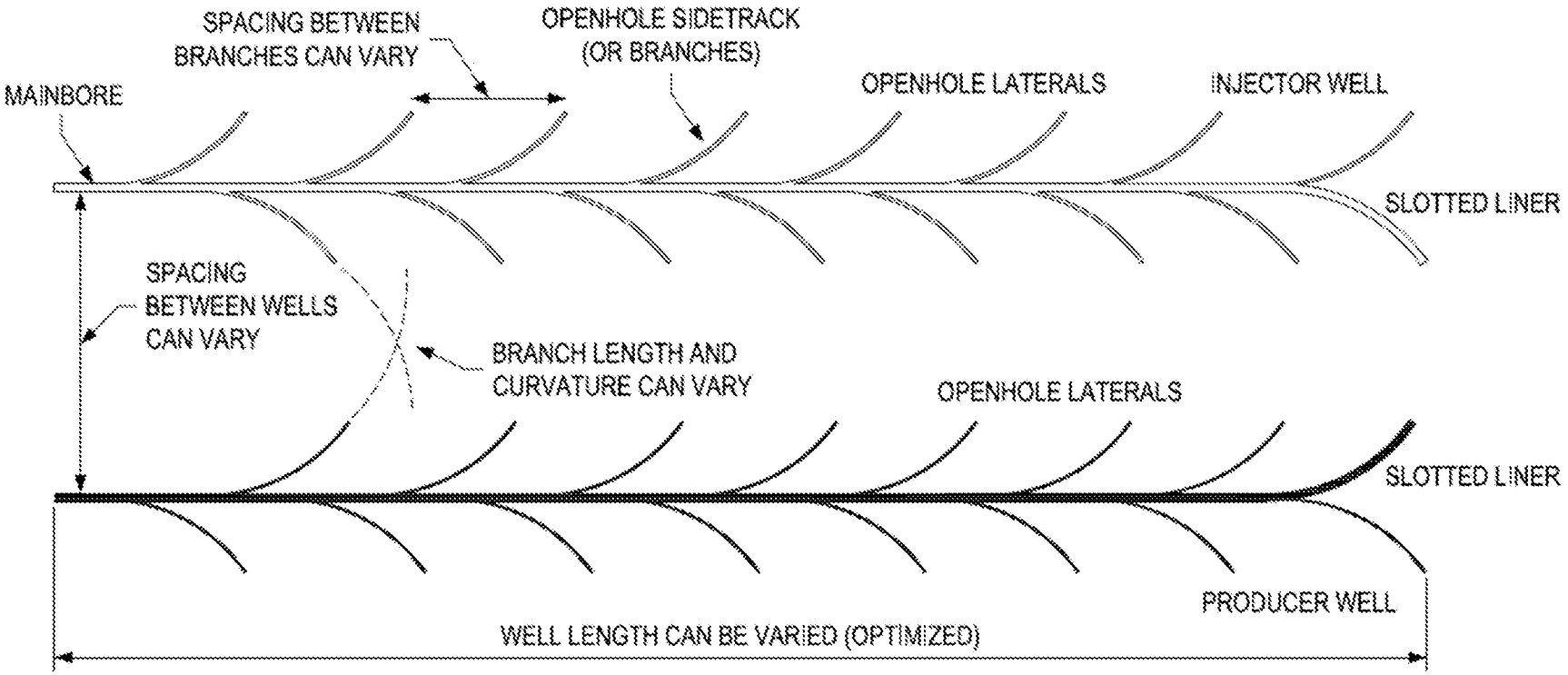
Figure 6:
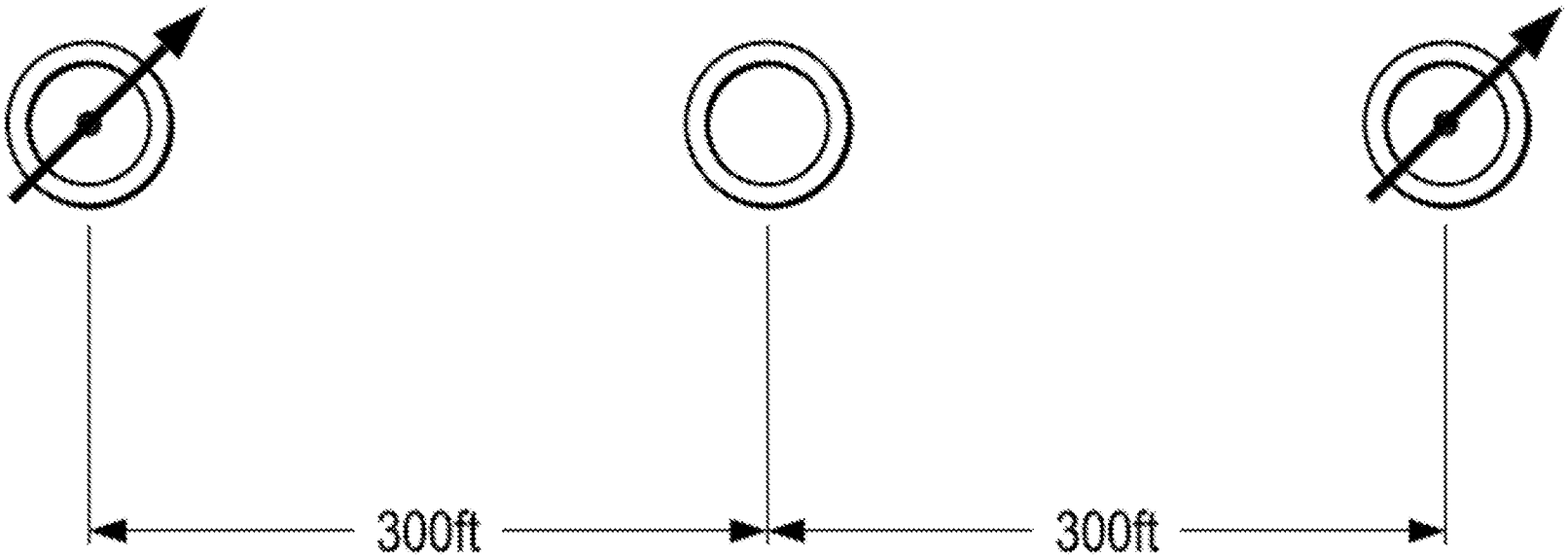
FIG. 6 shows a top view of vertical wells, wherein a producer is bracketed by a pair of injectors.
Figure 7:
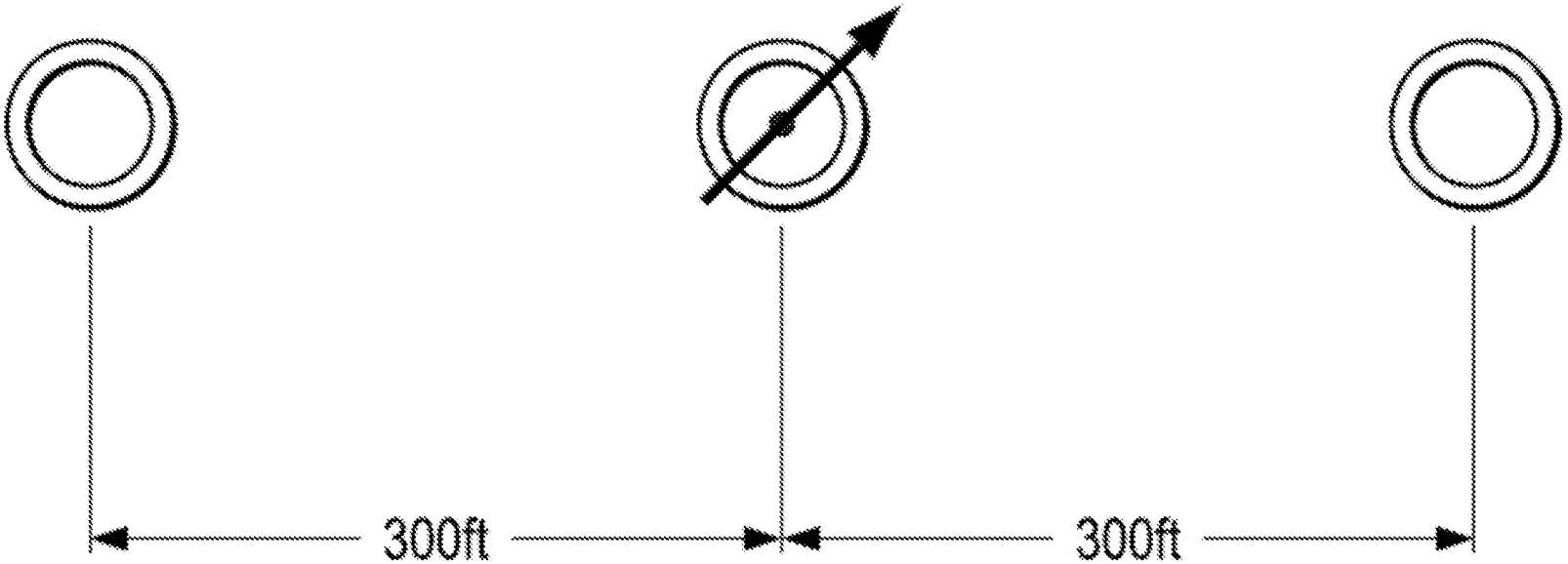
FIG. 7 shows a top view of vertical wells, wherein an injector is bracketed by a pair of producers.

The following is a detailed description of the preferred method of the present invention. It should be understood that the inventive features and concepts may be manifested in other arrangements and that the scope of the invention is not limited to the embodiments described or illustrated. The scope of the invention is intended to only be limited by the scope of the claims that are appended hereto.

The present invention provides a novel heavy oil production method, wherein heavy oil is heated and produced using electric downhole heaters and injected solvents until a preconditioning period is completed, said preconditioning period being determined by a reduction of the operating pressure (P) and a reduction of the operating temperature (T) from its high during the preconditioning period. Once the operating P&T are reduced, the well(s) can be converted to steam or steam and gas or steam and solvent based viscosity reduction methods for increased production of said heavy oil. Importantly, the reduction of operating P&T allow the use of lower temperature steam, thus mitigating risk to the permafrost.

In one embodiment, there is a method for production of heavy oil, the method comprising providing an injector well in a heavy oil reservoir at a first temperature and a first pressure, said injector well configured for electric downhole heating with an electric heater and for injection of one or more solvents. A producer well is also provided that configured for production of heavy oil, although this well can be used as an injector early in the preconditioning. The preconditioning period requires the injection of one or more solvents into said injection well, preferably NGLs, and heating the injector well with said electric heater for a time until said wells are in fluid communication and producing heavy oil at said producer well until said first pressure is reduced and a temperature high is reduced—thus operating P&T are reduced. Then the injector well is used in typical steam based processes, such as SAGD, ES-SAGD, and the like.

The producer well can also configured for electric downhole heating with an electric heater and also heated during the preconditioning. It can also be used for injection, but at some point production must be initiated and heating stopped for the operating P&T to be reduced.

The wells can be vertical wells or traditional horizontal SAGD well pairs or a-traditional wellpairs. Single wells could also be used.

In another method for production of heavy oil, the method comprises providing a well in a heavy oil reservoir at a first temperature and a first pressure, said well configured for electric downhole heating using an electric heater cable and for injection of one or more solvents; injecting one or more solvents into said well and heating said well with said electric heater cable during at least a part of a preconditioning period thus heating said well. Oil is producing at said well or an adjacent well until said first pressure is reduced and the temperature high is reduced, thus completing the preconditioning. Then steam is injected into said well at a lower temperature than would otherwise be required without said preconditioning period and continuing production of heavy oil at said well or an adjacent well.

Another method for production of heavy oil under permafrost comprises providing a well in a heavy oil reservoir with permafrost at a first temperature and a first pressure, said well configured for electric downhole heating using an electric heater cable and for injection of a natural gas liquid (NGL) produced at or near said well. A preconditioning period is commenced wherein the operator injects said NGL into said well to reduce a viscosity of heavy oil and heats said well with said electric heater cable to a second temperature. These two steps can be initiated simultaneously, or sequentially, either being first. The heavy oil is then produced at said well or an adjacent well until said first pressure is reduced, and the heating is discontinued at some point and oil further produced until said second temperature is reduced. Once the operating P&T drop, the preconditioning period is complete and the well can be operated using steam-based methods, wherein steam is injected into said well at a lower temperature than would otherwise be required without the preconditioning period. Steam can also be co-injected with gas or solvents or NGL, as desired.

Figure 8:
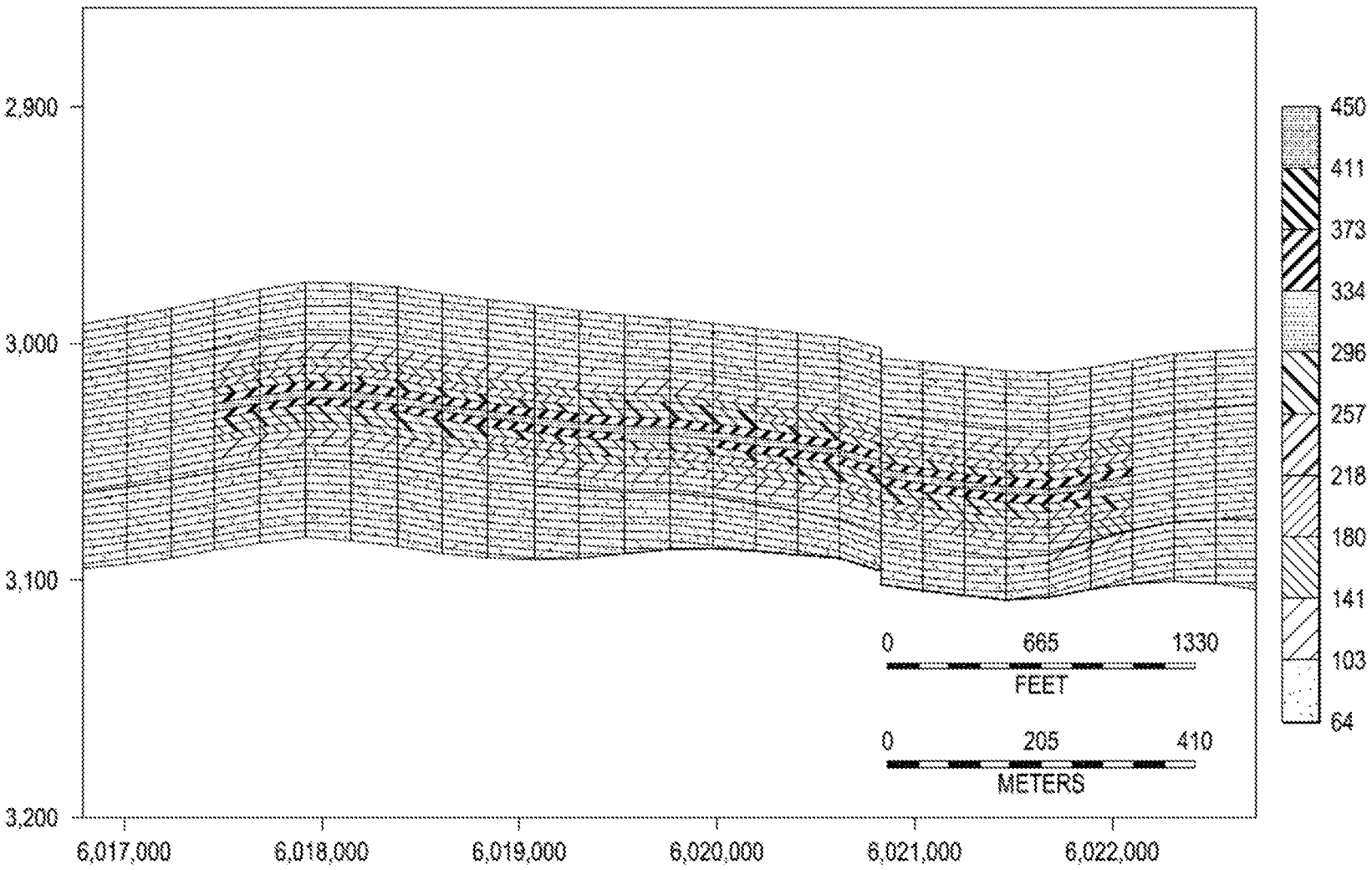
FIG. 8 is a cross-sectional temperature profile of steam injection alone, prepared by modeling using CGS-STARS.
Figure 9:
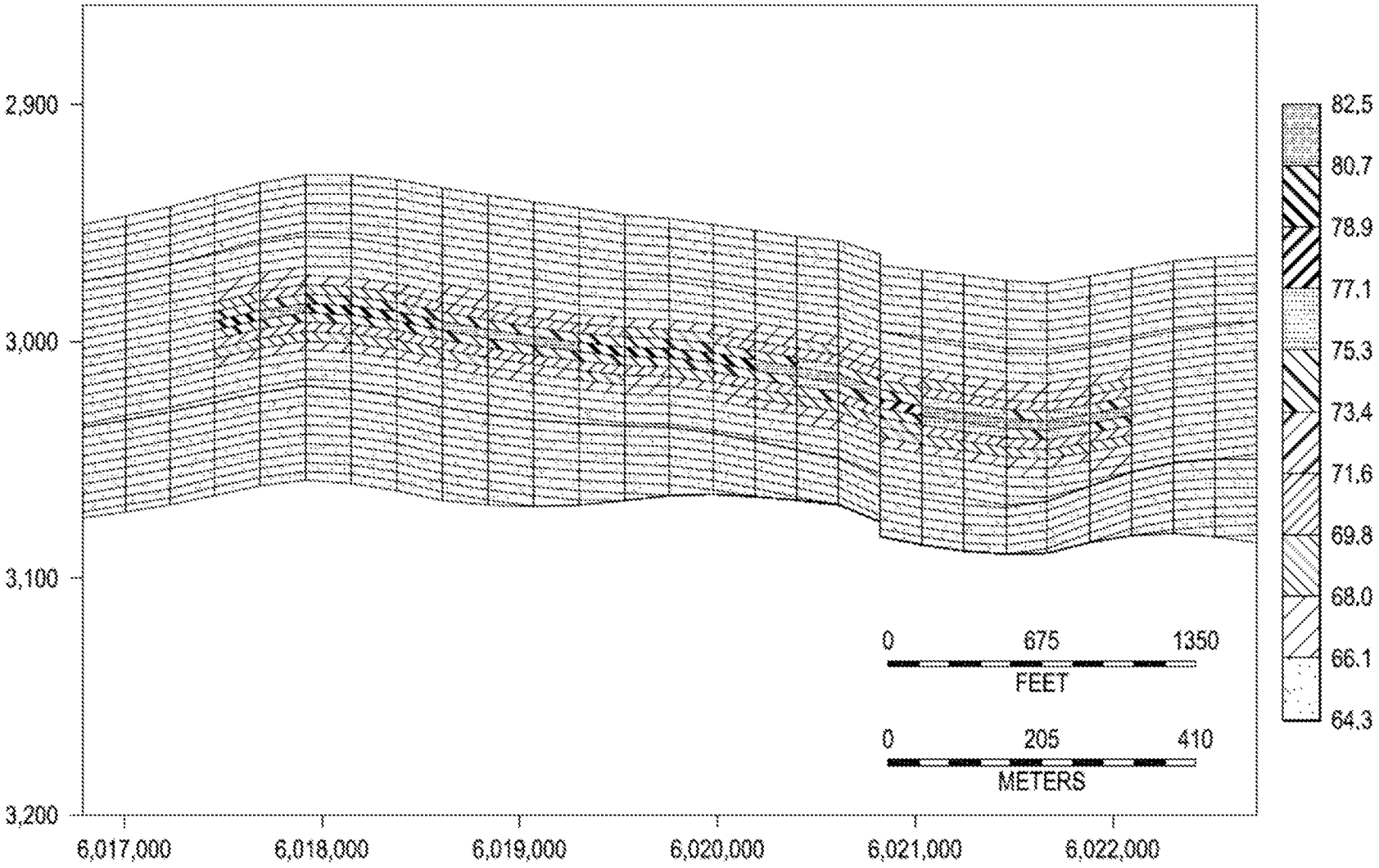
FIG. 9 is a cross-sectional temperature profile of downhole heating alone.
Figure 10:
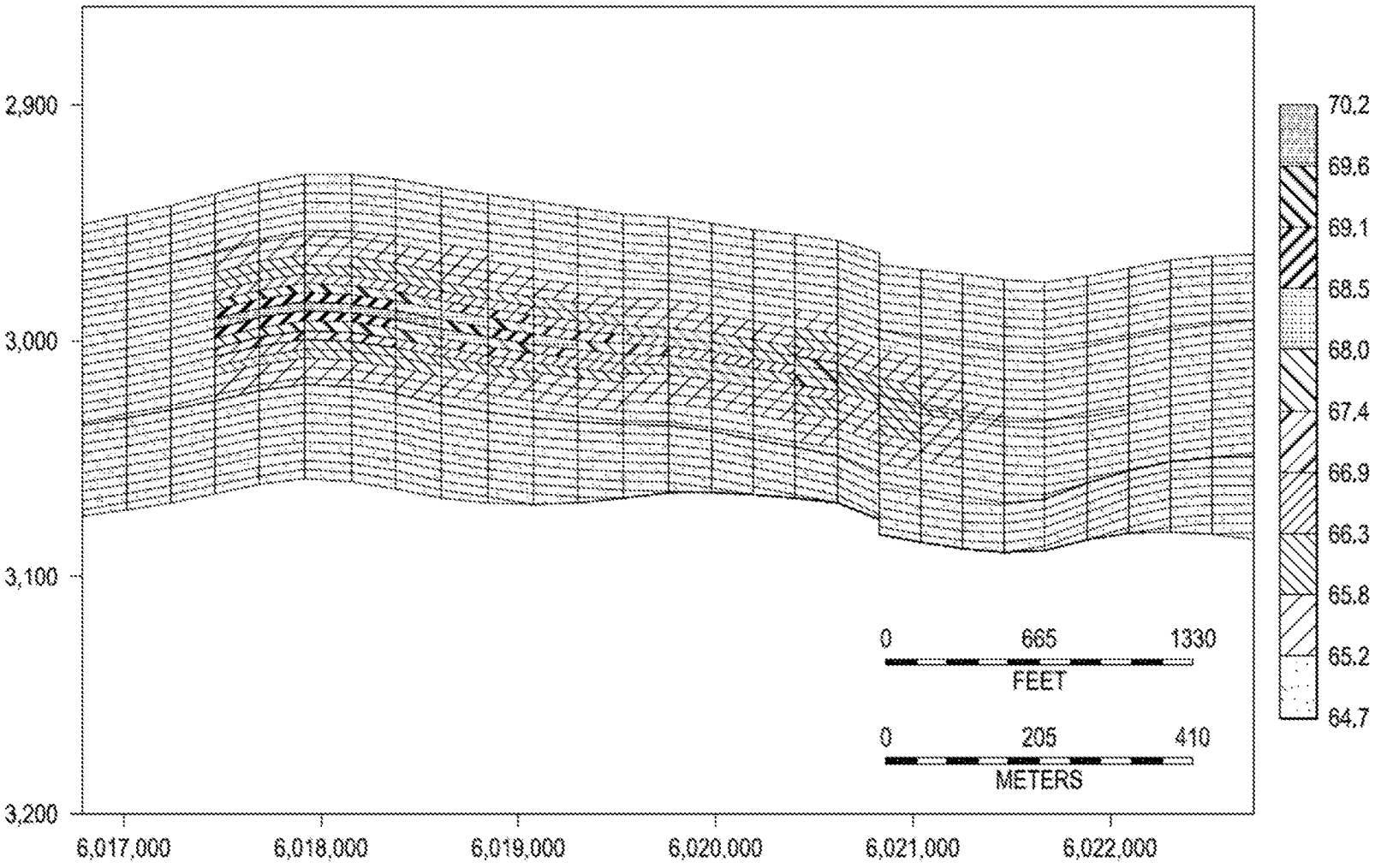
FIG. 10 is a cross-sectional temperature profile of downhole heating plus NGL injection.

We have performed simulations comparing steam injection with downhole heating as well as with downhole heating and NGL injection, as shown in FIGS. 8-10. As can be seen, less cumulative heat is required when combining electrical heating and NGL injection than with either steam or electrical heating alone. Furthermore, it could also be seen from the temperature profiles of the cross-sectional area that the near wellb ore temperature for SAGD case is significantly higher than for downhole heating and downhole heating with NGL injection cases. SAGD could have higher heat losses to the permafrost as the fluids are being produced. Therefore, downhole heating and downhole heating with NGL injection could provide alternative oil recovery methods with a low risk to the permafrost since the produced fluids would not be significantly higher in temperature.

Although particularly beneficial in gravity drainage techniques, this is not essential and the configuration could be used for horizontal sweeps as well. Thus, the methods and configurations can also be applied to vertical wells comprising single producers bracketed by injectors or the reverse.

What is claimed is:

1. A method for production of heavy oil, the method comprising:

a) providing an injector well in a heavy oil reservoir at a first pressure, said injector well configured for electric downhole heating with an electric heater and configured for injection of a fluid;

b) providing a producer well configured for production of said heavy oil;

c) preconditioning said injector well and said producer well by heating said injector well with said electric heater and injecting a fluid selected from a solvent or natural gas liquid (NGL) into said injector well for a preconditioning period of time until said injector well and said producer well are in fluid communication;

d) producing said heavy oil at said producer well until said first pressure is reduced;

e) determining a steam injection temperature and pressure based on the reduced first pressure;

f) then, injecting steam into said injector well at said steam injection temperature and pressure; wherein said steam injection temperature and pressure are lower than required in a same method performed in said reservoir, but without said steps c) and d); and, g) continuing production of said heavy oil at said producer well.

2. The method of claim 1, wherein said producer well is also configured for electric downhole heating with an electric heater and is also heated during said preconditioning step c).

3. The method of claim 1, wherein said electric heater is deployed inside said injector well.

4. The method of claim 1, wherein said heating step with said electric heater is discontinued before said injecting steam step f).

5. The method of claim 1, wherein said injecting steam step f) is co-injection of steam and a gas or solvent.

6. The method of claim 1, wherein said producer well and said injector well are vertically stacked horizontal wells.

7. The method of claim 1, wherein said producer well and said injector well are vertically stacked horizontal wells about 5 meters vertically apart.

8. The method of claim 1, wherein said producer well and said injector well are vertical wells.

9. The method of claim 1, wherein said fluid is methane, ethane, propane, butane, pentane, hexane or mixtures thereof.

10. The method of claim 1, wherein said fluid is an NGL produced at said reservoir.

11. A method for production of heavy oil, the method comprising:

a) providing a first well in a heavy oil reservoir at a first pressure, said first well configured for electric downhole heating using an electric heater cable and configured for injection of a fluid;

b) heating said first well with said electric heater cable and simultaneously or sequentially or a combination thereof injecting a fluid into said first well, said fluid selected from a solvent or a natural gas liquid (NGL);

c) producing said heavy oil at said first well or at an adjacent well until said first pressure is reduced to a second pressure;

d) determining a steam injection temperature and pressure based on the second pressure;

e) then, injecting steam into said first well at said steam injection temperature and pressure; wherein said steam injection temperature and pressure are lower than required in a same method performed in said reservoir, but without steps b) and c); and, f) continuing production of said heavy oil at said first well or said adjacent well.

12. The method of claim 11, wherein said electric heater cable is deployed inside said first well.

13. The method of claim 11, wherein said adjacent well is also configured for electric downhole heating with an electric heater cable and is also heated during step b).

14. The method of claim 11, wherein said injecting steam step e) is co-injection of steam and a gas or a solvent.

15. The method of claim 11, wherein said fluid is methane, ethane, propane, butane, pentane, hexane, or mixtures thereof.

16. The method of claim 11, wherein said fluid is an NGL produced at said reservoir.

17. A method for production of heavy oil in a region of permafrost, the method comprising:

a) providing a first well in a heavy oil reservoir in a region of permafrost, said heavy oil reservoir at a first temperature and a first pressure, said first well configured for electric downhole heating using an electric heater cable and configured for injection of a natural gas liquid (NGL) produced at said reservoir;

b) heating said first well with said electric heater cable to heat said first well to a second temperature to reduce a viscosity of said heavy oil;

c) injecting an NGL produced at said reservoir into said first well to further reduce the viscosity of said heavy oil;

d) producing said heavy oil at said first well or an adjacent well until said first pressure is reduced;

e) discontinuing said heating step b);

f) producing said heavy oil at said first well or said adjacent well until said second temperature is reduced;

g) determining a steam injection temperature and pressure based on the reduced first pressure;

h) then, injecting steam into said first well at said steam injection temperature and pressure; wherein said steam injection temperature and pressure are lower than required in a same method in said reservoir but without steps b-f), thereby reducing a risk of melting said permafrost; and, i) continuing production of said heavy oil at said first well or said adjacent well.

18. The method of claim 17, wherein said adjacent well is also configured for electric downhole heating with an electric heater cable and is also heated during step b).

* * * * *